US005450841A

United States Patent [19]

Whitaker et al.

[11] Patent Number: 5,450,841

[45] Date of Patent: Sep. 19, 1995

[54] MULTI-FUNCTION REMOTE CONTROL SYSTEM FOR GAS FIREPLACE

[75] Inventors: Louis G. Whitaker, Alliance; Dennis W. Waggamon, North Canton, both of Ohio

[73] Assignee: GMI Holding, Inc., Del.

[21] Appl. No.: 63,286

[22] Filed: May 18, 1993

[51] Int. Cl.[6] ..... F24C 3/00

[52] U.S. Cl. ..... 126/512; 126/536; 236/51

[58] Field of Search ..... 126/512, 504, 536, 537, 126/538, 539; 236/51

[56] References Cited

U.S. PATENT DOCUMENTS

| | | | |
|---|---|---|---|
| 3,877,639 | 4/1975 | Wilson et al. | 236/51 X |
| 4,336,902 | 6/1982 | Neal | 236/51 X |
| 4,404,697 | 9/1983 | Hatcher . | |
| 4,482,947 | 11/1984 | Zato et al. . | |
| 4,649,808 | 3/1987 | Ward et al. | 126/536 X |
| 4,860,950 | 8/1989 | Resser et al. | 236/51 |
| 4,892,087 | 1/1990 | Bridgwater | 126/512 |
| 4,924,564 | 5/1990 | Shah | 126/512 |
| 4,949,705 | 8/1990 | Smith | 126/512 |
| 4,962,750 | 10/1990 | Bridgwater | 126/503 |
| 5,000,162 | 3/1991 | Shimek et al. | 126/512 |
| 5,104,037 | 4/1992 | Karg et al. | 236/51 X |
| 5,113,665 | 5/1992 | Katsuki | 236/51 X |
| 5,191,877 | 3/1993 | Shimek et al. | 126/512 |

FOREIGN PATENT DOCUMENTS

| | | | |
|---|---|---|---|
| 2099607 | 7/1981 | United Kingdom | 126/39 BA |

OTHER PUBLICATIONS

Genie Home Products, Inc., pp. 1–2, North American Philips Company, Form No. 6915–01B.

*Primary Examiner*—Carl D. Price

*Attorney, Agent, or Firm*—Rankin, Hill, Lewis & Clark

[57] ABSTRACT

A control unit remotely operates several different functions of a gas fireplace. The functions include ignition of a fire, control of flame height, blower control, and damper control. An RF or IR transmitter has several different switches corresponding to desired operations to be performed. Each switch or combination of switches sends different coded signals to a receiver in the control unit. The control unit operates a gas valve and an ignitor to start the fire in response to a start signal. The gas valve is further controlled to vary the height of the flame or extinguish the flame in response to corresponding signals. The blower, damper and other functions can be controlled in response to other signals.

19 Claims, 1 Drawing Sheet

MULTI-FUNCTION REMOTE CONTROL SYSTEM FOR GAS FIREPLACE

BACKGROUND OF THE INVENTION

1. Field of the Invention

This invention relates generally to the field of fireplace control and specifically to a multi-function remote controller for a gas fireplace.

2. Description of Related Art

Gas fireplaces and gas starters for woodburning fireplaces are becoming increasingly popular in homes because they eliminate many of the inconveniences of a traditional fireplace while retaining the charm and atmosphere of a real fire. Typically, a manually operated valve controls gas flow to the fireplace. Ignition is accomplished with a match, a pilot light, or an automatic starter such as the one shown in U.S. Pat. No. 4,949,705 to Smith. A variable speed blower may be associated with a gas fireplace to direct hot air into a room for improved heating efficiency. The blower is powered by an electric motor, and its speed is varied by a multiposition control. A damper may also be provided to open and close a flue of the fireplace. The damper is typically operated by an arrangement of levers.

To add to the convenience of a gas fireplace, it is desirable to remotely control the functions of such a fireplace from various locations around the room. U.S. Pat. No. 4,962,750 to Bridgewater shows a wireless (infrared or radio frequency) remote controller for a gas fireplace which automatically ignites the fireplace. U.S. Pat. No. 4,924,564 to Shah shows an ultrasonic remote control which can be used to turn a fireplace or other appliance on and off.

It is desirable to be able to remotely control functions of a gas fireplace other than ignition, such as flame height, along with a blower speed. Such a controller should be simple to operate, compact, and inexpensive.

SUMMARY OF THE INVENTION

The present invention provides a controller for a gas fireplace, including means to start and to stop gas flow to the fireplace, means to control the volume of gas flowing to the fireplace, and means to control blower speed. The controller is provided with means to operate the flow control responsive to a first coded signal received by the receiver so as to permit gas to flow into the fireplace and be ignited by the ignition means and to block the flow of gas to the fireplace, means to operate a flow control responsive to a second coded signal received by the receiver so as to modulate gas flow to the fireplace, and means to control another function of the fireplace responsive to a third signal received by the receiver. The function responsive to the third signal may be the operation of a blower associated with the fireplace.

The function controlled in response to the first signal preferably operates to either start or stop the flow of gas to the fireplace. The controller may be provided with a means to sense a condition in the fireplace or to recall operations performed the immediately preceding time the signal was received. Thus, the controller can automatically determine whether to ignite or extinguish the fire when the signal is received. Alternatively, the function controlled in response to the first signal can be only the ignition of the fireplace, in which case an additional separate signal would be used to extinguish the flame.

The function controlled in response to the second signal can be modulation of the flow or pressure control to vary the gas flow and thus adjust the flame height.

The function controlled in response to the third signal can be the operation of a blower to vary the air forced into the room from the fireplace. The function control can include. different states, such as variable or multispeed blower control. Alternatively, the function controlled in response to the third signal can be the operation of a damper to allow exhaust gases from the fireplace to escape, or operation of some other device associated with the fireplace.

Additional signals may also be used to control other functions, such as the damper operating function or the flame extinguishing function already described.

A remote control transmitter capable of sending a plurality of coded signals to the receiver is also provided. Thus, complete control of fireplace functions can be achieved with a single transmitter from a location remote from the fireplace.

DESCRIPTION OF THE PREFERRED EMBODIMENTS

Figure 1:
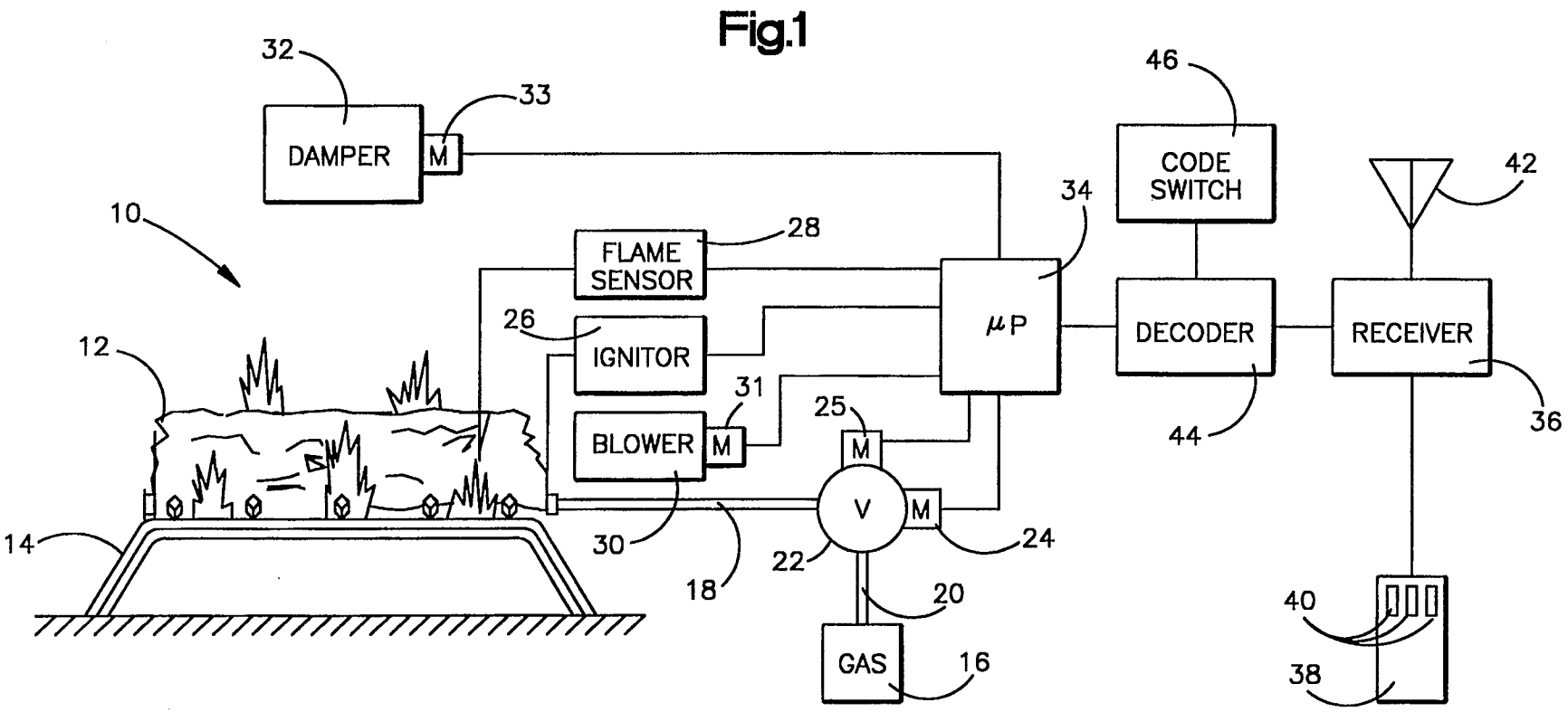
FIG. 1 shows a schematic diagram of a gas fireplace and an associated remote control system according to the invention.

Referring to the FIG. 1, a fireplace 10 includes a log 12 supported on a grate 14. The log 12 can be wood or another combustible substance, however, the preferred embodiments described herein relate to a fireplace having an "artificial" log which gives the appearance of burning, but does not actually burn. A supply 16 of natural gas or other fuel is provided to the fireplace through a conduit 18 and a supply pipe 20. As is known in the art, the fireplace pipe includes holes or a more elaborate mechanism to distribute gas in the fireplace so that the gas, when ignited, forms flames which give the appearance of a wood fire. A valve 22 controls the flow of gas from the supply 16 to the fireplace 10. The valve 22 is operable by a suitable control means 24, preferably a millivolt control circuit commonly used in gas burners that allows gas flow if the pilot is present. Alternatively, the valve 22 can be operated by an electric motor.

Preferably, the valve 22 includes a throttle, an adjustable orifice or a pressure regulator to permit the velocity of the gas flowing through the valve to be adjusted in addition to permitting the flow volume of gas to be adjusted. The adjustment of the valve 22 is preferably accomplished by a motor 25. Thus by operation of the control 24, the valve 22 can be opened or closed to start and stop the flow of gas to the fireplace, and by operation of the motor 25, the volume of the gas flow to the fireplace may be increased or decreased. By adjusting the velocity of the flow of gas to the fireplace, the user may adjust the height of the flame produced by the fireplace.

The fireplace 10 also includes an ignitor 26 located near the conduit 18. The ignitor 26 is preferably a pilot light, but it may be any one of several known types such as a spark ignitor. The ignitor 26 is adapted to ignite gas flowing into the fireplace from the conduit 18. A flame sensor 28 of a known type may be provided in the fireplace 10 to sense whether the gas is burning.

A blower 30, such as a fan powered by a motor 31, is provided in the fireplace 10 to draw room air into the fireplace and force heated air out of the fireplace into the room. Thus, the fire can be used to heat the room more efficiently than a conventional fireplace. The blower 30 can have multiple speeds which are remotely controlled as described below.

The fireplace 10 may include a flue for venting exhaust gases produced by combustion. The flue is closed with a damper 32 operated by an electric motor 33. Typically, such a damper 32 is a flapper valve operated by a lever which can be connected to the motor through a gear arrangement as is well known. The damper may be provided with a position sensor (not shown).

A controller 34, such as a microprocessor, is provided to control operation of the functions or devices described above and/or other functions or devices which may be associated with the fireplace 10. The controller 34 is connected to control the valve 22, the ignitor 26, the blower 30, and the damper 32. The controller is also connected to receive information from the flame sensor 28.

A receiver 36 is provided to receive signals from a transmitter 38. The transmitter 38 includes a plurality of switch devices, such as pushbuttons 40, adapted to send unique digitally coded signals. Each of the signals sent by the transmitter 38 may be programmed into the transmitter by setting DIP switches (not shown) in the transmitter or by other means known in the art. The transmitter 38 shown includes three or more pushbuttons 40 which can be selectively depressed alone or in combination to produce and transmit the different signals. The signals are preferably transmitted as radio frequency (RF) signals and received by an antenna 42. Alternatively, the signals can be infrared, ultrasonic, carrier current, or some type. Preferably, the signals are wireless to permit flexibility in locating and moving the transmitter 38. A decoder 44 is connected between the receiver 36 and the controller 34 to convert the coded signals to commands which correspond to the pushbuttons 40 actuated by a user. A code switch 46 which is connected to the decoder 44 contains switches that can be set to match the DIP switch settings in the transmitter 38 so that only the coded signals from the transmitter are decoded.

The controller 34 is assembled or programmed so as to be able to receive input commands from a user and control the operation of the various functions of the fireplace. Each pushbutton or combination of pushbuttons 40 corresponds to a command to be executed by the controller.

In operation, a user depresses one of the pushbuttons 40 which is associated with the starting or igniting function of the fireplace 10. A coded signal is sent from the transmitter 38 to the receiver 36, decoded, and input to the controller 34. The controller 34 responds to the signal by completing the pilot flame sensor circuit control 24 to open the valve 22 thereby permitting gas to flow from the supply 16 to the conduit 18.

Various other starting sequences are contemplated by the invention. For example, if the ignitor 26 is a spark ignitor, the ignitor must be actuated to create a spark which ignites the gas in the fireplace when the valve 22 is opened. Where the flame sensor 28 is used, the ignitor 26 may continue attempting to ignite the gas until a flame is sensed in the fireplace. An interlock can be provided to prevent starting a fire when the damper 32 is closed.

Flame height can be controlled by depressing one of the pushbuttons 40 to transmit a signal corresponding to the function of flame height control. The signal causes the controller 34 to operate the motor 25 to use the valve 22 to control the gas flow pressure to achieve the desired flame height. The valve 22 can be controlled by adjusting the gas flow so long as the pushbutton is depressed or the pushbutton can be depressed several times to select different discrete flame heights.

To extinguish the flame, the user selects one of the pushbuttons 40 which sends a coded signal corresponding with the extinguishing function. Preferably the user actuates the same pushbutton 40 used to start the fireplace, and this pushbutton toggles the flame on and off. With the fireplace operating and the flame on, the actuation of this pushbutton 40 causes the controller 34 to close the valve 22 blocking gas flow to the fireplace.

The pushbutton 40 corresponding to the extinguishing function is preferably the same pushbutton which is used for the ignition function. When a flame is not sensed by the sensor 28 and this pushbutton 40 is depressed, the controller 34 opens the valve 22 and operates the ignitor 26. When a flame is sensed and this pushbutton 40 is depressed, the controller 34 closes the valve 22. Alternatively, the controller 34 could be adapted to recall the function which was performed the last time this pushbutton was depressed and, thus, perform the opposite function.

If the same pushbutton 40 is not used for both igniting and extinguishing the flame, a separate pushbutton can be provided for the extinguishing function.

When a user desires to operate the blower 26, the appropriate pushbutton 40 is depressed to send a corresponding coded signal from the transmitter 38 to the receiver 36. The controller 34 responds to the signal by turning the blower 26 on or off or by changing the speed of the blower between a number of predetermined speed settings. The operation is preferably such that each time this pushbutton is depressed, the speed of the blower is changed in step-wise fashion. Alternatively, the speed of the blower can be varied continuously based upon the duration of the depression of the pushbutton. Alternatively, one of the pushbuttons 40 can be used to turn the blower on and off and another of the pushbuttons can be used to control blower speed.

Other functions of the fireplace can also be controlled. For example, the flue damper 32 can be opened and closed by the controller 34 in response to signal generated by another selected pushbutton 40 on the transmitter 38. In addition, a fireplace door or screen could be controlled. Accordingly, other functions of the fireplace 10 which have not been described could be controlled in a similar manner in addition to or in place of the functions described above.

The invention provides a simple and efficient apparatus for controlling several functions of a fireplace from a single remote location. The present disclosure describes several embodiments of the invention, however, the invention is not limited to these embodiments. Other variations are contemplated to be within the spirit and scope of the invention and appended claims.

What is claimed is:

1. A gas fireplace assembly, which comprises:

a decorative fireplace, comprising a grate, and a decorative log resting on the grate;

a supply for providing gas to the fireplace;

a burner connected to the supply adjacent to the log to produce a flame when ignited creating a simulated wood flame;

first valve means for starting and stopping gas flow to the fireplace;

an ignitor for igniting gas flowing to the fireplace from the valve means;

second valve means for controlling the height of the simulated wood frame in the fireplace;

a multi-speed blower for controlling flow of air drawn in to the fireplace and flow of air heated by the burner from the fireplace;

a controller operatively connected to the first valve means and the ignitor and connected to the second valve means and connected to the blower; and a remote control system which comprises a transmitter remote from the fireplace for generating first and second and third coded signals and for wireless transmitting of the coded signals, and a receiver connected to the controller for wireless receipt of the first and second and third coded signals from the transmitter, the controller connected to the receiver, the controller responsive to the receipt of the first coded signal to operate the valve means to permit gas to flow into the fireplace and to operate the ignitor to ignite the gas, the controller responsive to the receipt of a second coded signal to adjust the height of the flame in the fireplace, the controller responsive to the receipt of the third coded signal to control the blower to regulate air flow to and from the fireplace.

2. A gas fireplace assembly according to claim 1, wherein the controller is also responsive to the receipt of the first coded signal to stop tile gas flow to the fireplace.

3. A gas fireplace assembly according to claim 1, further comprising a flame sensor connected to the controller for sensing the presence of a flame ill the fireplace, the controller operating the valve means and the ignitor responsive to conditions sensed by tile flame sensor.

4. A gas fireplace assembly according to claim 1, wherein the transmitter transmits the coded signals and the receiver receives the coded signals by radio frequency transmission.

5. A gas fireplace assembly according to claim 1, wherein tile transmitter is all integrated, portable unit.

6. A gas fireplace assembly according to claim 5, wherein the transmitter comprises a plurality of switches adapted to select a coded signal to be transmitted.

7. A gas fireplace assembly according to claim 6, wherein each of the plurality of switches are pushbuttons.

8. A gas fireplace assembly according to claim 1, wherein the transmitter also generates a fourth coded signal and the receiver receives the fourth coded signal, and wherein tile controller is responsive to the receipt of tile fourth coded signal to control an additional function of tile fireplace.

9. A gas fireplace assembly according to claim 8, wherein the controller is responsive to the receipt of the first coded signal to start the gas flow to the fireplace, and the controller is responsive to the receipt of the fourth coded signal to stop the gas flow to the fireplace.

10. A gas fireplace assembly, which comprises:

a decorative fireplace, comprising a grate, and a decorative log resting on the grate;

a supply for providing gas to the fireplace;

a burner connected to the supply adjacent to the log to produce a flame when ignited creating a simulated wood frame in the fireplace;

a first valve to start and stop gas flow to the fireplace;

an ignitor located in the fireplace to ignite gas in the fireplace;

a second valve to adjust the height of the flame in the fireplace;

a multi-speed blower for controlling flow of air drawn into the fireplace and flow of air heated by the burner from the fireplace;

a controller to control the first valve and the ignitor and the second valve and the blower; and a remote control system which comprises a receiver connected to the controller for receipt of first and second and third coded signals, the controller connected to the receiver and responsive to the receipt of the first coded signal to operate the valve to start or stop gas flow to the fireplace and to operate the ignitor to ignite the gas, the controller responsive to the receipt of a second coded signal to operate the second valve to adjust the height of the time, the controller responsive to the receipt of a third coded signal to control the blower to regulate air flow to and from the fireplace, and a transmitter remote from the fireplace for generating first and second and third coded signals and for transmitting the coded signals by wireless means to the receiver.

11. A gas fireplace assembly according to claim 10, wherein the first coded signal comprises two different signals, one signal to start the flow of gas by the first valve and the other signal to stop the flow of gas by first valve.

12. A gas fireplace assembly according to claim 10, wherein the transmitter transmits the coded signals and the receiver receives tile coded signals by radio frequency transmission.

13. A gas fireplace assembly according to claim 10, wherein tile transmitter is an integrated, portable unit.

14. A gas fireplace assembly according to claim 13, wherein the transmitter comprises a plurality of switches adapted to select a coded signal to be transmitted.

15. A gas fireplace assembly according to claim 4, wherein each of the plurality of switches are pushbuttons.

16. A gas fireplace assembly according to claim 10, wherein the transmitter also generates and transmits a fourth coded signal, and wherein the receiver is connected to the controller for receipt of the fourth coded signal and the controller is responsive to the receipt of the fourth coded signal to control an additional function of the fireplace.

17. A gas fireplace assembly according to claim 16, wherein the controller is responsive to the receipt of the first coded signal to start the gas flow to the fireplace, and the controller is responsive to the receipt of the fourth coded signal to stop the gas flow to the fireplace.

18. A gas fireplace assembly, comprising:

a decorative fireplace, comprising a grate, and a decorative log resting on the grate;

a supply for providing gas to the fireplace;

a burner connected to the supply adjacent to the log to produce a flame when ignited creating a simulated wood time;

first valve means for starting and stopping gas flow to the burner;

an ignitor for igniting gas flowing to the burner from the valve means;

second valve means for controlling the height of the flame;

a blower for controlling flow of air drawn into the fireplace and flow of air heated by the burner from the fireplace;

a motor-operated flue damper for opening and closing the exhaust flue from the fireplace, a controller operatively connected to the first valve means and the ignitor and connected to the second valve means and connected to the blower and operatively connected to the flue damper; and a remote control system which comprises a transmitter remote from the fireplace for generating first and second and third and fourth coded signals and for wireless transmitting of the coded signals, and a receiver connected to the controller for wireless receipt of the first and second and third and fourth coded signals from the transmitter, the controller connected to the receiver, the controller responsive to the receipt of the first coded signal to operate the valve means to permit gas to flow to the burner and to operate the ignitor to ignite the gas, the controller responsive to the receipt of a second coded signal to adjust the height of the time, the controller responsive to the receipt of the third coded signal to operate the blower to control air flow to and from the fireplace, the controller responsive to the receipt of the fourth coded signal to operate the flue damper to open and close the exhaust flue.

19. A gas fireplace assembly, which comprises:

a decorative fireplace, comprising a grate, and a decorative log resting on the grate;

a supply for providing gas to the fireplace;

a burner connected to the supply adjacent to the log to produce a flame when ignited creating a simulated wood flame;

a first valve to start and stop gas flow to the burner;

an ignitor located at the burner to ignite gas at the burner;

a second valve to adjust the height of the time;

a blower for controlling flow of air drawn to the fireplace and flow of air heated by the burner from the fireplace;

a motor-operated flue damper for opening and closing the exhaust flue from the fireplace;

a controller to control the first valve and the ignitor and the second valve and the blower; and a remote control system which comprises a receiver connected to the controller for receipt of first and second and third and fourth coded signals, the controller connected to the receiver and responsive to the receipt of the first coded signal to operate the valve to start or stop gas flow to the burner and to operate the ignitor to ignite the gas, the controller responsive to the receipt of a second coded signal to operate the second valve to adjust the height of the time, the controller responsive to the receipt of a third coded signal to operate the blower, the controller responsive to the receipt of a fourth coded signal to operate the flue damper to open and close the exhaust flue; and a transmitter remote from the fireplace for generating first and second and third and fourth coded signals and for transmitting the coded signals by wireless means to the receiver.

* * * * *

UNITED STATES PATENT AND TRADEMARK OFFICE

CERTIFICATE OF CORRECTION

PATENT NO. : 5,450,841

DATED : September 19, 1995

INVENTOR(S) : Louis G. Whitaker & Dennis W. Waggamon

It is certified that error appears in the above-indentified patent and that said Letters Patent is hereby corrected as shown below:

Col. 5, line 6 after wood delete "frame" and insert --flame--
Col. 5, line 8 after drawn delete "in to" and insert --into--
Col. 5, line 33 delete "tile" and insert --the--
Col. 5, line 37 after flame delete "ill" and insert --in--
Col. 5, line 39 after by delete "tile" and insert --the--
Col. 5, line 46 after wherein delete "tile" and insert --the--
Col, 5, line 46 after is delete "all" and insert --an--
Col. 5, line 57 after wherein delete "tile" and insert --the--
Col. 5, line 58 after receipt of delete "tile" and insert --the--
Col. 5, line 59 delete "tile" and insert --the--
Col. 6, line 4 after wood delete "frame" and insert --flame--
Col. 6, line 24 delete "time" and insert --flame--
Col. 6, line 40 after receives delete "tile" and insert --the--
Col. 6, line 43 delete "tile" and insert --the--
Col. 6, line 48 after claim delete "4" and insert --14--
Col. 7, line 3 after wood delete "time" and insert --flame--
Col. 7, line 34 delete "time" and insert --flame--
Col. 8, line 12 delete "time" and insert --flame--
Col. 8, line 13 after drawn delete "to" and insert --into--
Col. 8, line 29 delete "time" and insert --flame--

Signed and Sealed this

Twenty-sixth Day of December, 1995

*Attest:*

Bruce Lehman

BRUCE LEHMAN

*Attesting Officer*

*Commissioner of Patents and Trademarks*